US012338042B2

(12) United States Patent
Corthell

(10) Patent No.: US 12,338,042 B2
(45) Date of Patent: Jun. 24, 2025

(54) BOTTLE CAP DEVICE WITH PRESSURIZED RELEASE

(71) Applicant: CORTHELL, Max, Tacoma, WA (US)

(72) Inventor: Max Corthell, Tacoma, WA (US)

( * ) Notice: Subject to any disclaimer, the term of this patent is extended or adjusted under 35 U.S.C. 154(b) by 194 days.

(21) Appl. No.: 17/213,907

(22) Filed: Mar. 26, 2021

(65) Prior Publication Data

US 2022/0306362 A1 Sep. 29, 2022

(51) Int. Cl.
*B65D 51/28* (2006.01)

(52) U.S. Cl.
CPC ..... *B65D 51/2842* (2013.01); *B65D 51/2828* (2013.01); *B65D 51/2857* (2013.01)

(58) Field of Classification Search
CPC ..... B65D 51/2857; B65D 51/2828; B65D 51/2842; B65D 51/2807; B65D 81/3222
See application file for complete search history.

(56) References Cited

U.S. PATENT DOCUMENTS

| | | | | |
|---|---|---|---|---|
| 8,408,389 | B1 | 4/2013 | Anderson | |
| 9,321,570 | B2 | 4/2016 | Kim et al. | |
| 2010/0012193 | A1 | 1/2010 | Anson | |
| 2010/0200437 | A1* | 8/2010 | Coon | B65D 81/3222 215/DIG. 1 |
| 2011/0174642 | A1 | 7/2011 | Coon | |
| 2011/0192735 | A1 | 8/2011 | Cronin et al. | |
| 2012/0193362 | A1 | 8/2012 | Porter | |
| 2014/0042185 | A1* | 2/2014 | Porter | B65D 51/2828 222/82 |
| 2014/0209490 | A1 | 7/2014 | McKeown et al. | |
| 2015/0203260 | A1* | 7/2015 | Kim | B65D 51/2814 426/112 |
| 2020/0189815 | A1 | 6/2020 | Grobman | |

FOREIGN PATENT DOCUMENTS

| | | | |
|---|---|---|---|
| KR | 20170127736 | A | 11/2017 |

OTHER PUBLICATIONS

PCT International Search Report and Written Opinion dated Jun. 21, 2022, issued during the prosecution of PCT International Patent Application No. PCT/US2022/022178, 12 pages.
Extended European Search Report dated Feb. 24, 2025, issued during the prosecution of PCT International Patent Application No. PCT/US2022/022178, 9 pages.

* cited by examiner

*Primary Examiner* — Anthony D Stashick
*Assistant Examiner* — Lauren Kmet
(74) *Attorney, Agent, or Firm* — Troutman Pepper Locke LLP; Gabrielle L. Gelozin

(57) ABSTRACT

A bottle cap is disclosed, which includes a top portion, comprising a hingeable lid, a middle portion, comprising a reservoir for retaining a material, and a bottom portion, which is surrounded by a threading that further comprises a means for attaching to a bottle. The top portion of the bottle cap further comprises a depressible button for exerting pressure in said reservoir, wherein said reservoir further contains a means for releasing said material into said bottle upon the exertion of pressure from said depressible button.

19 Claims, 5 Drawing Sheets

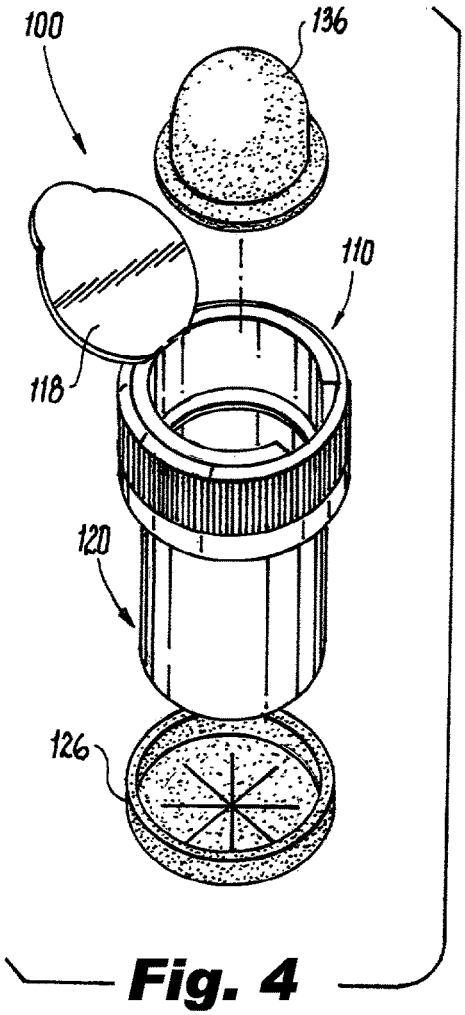
Fig. 4
Fig. 5
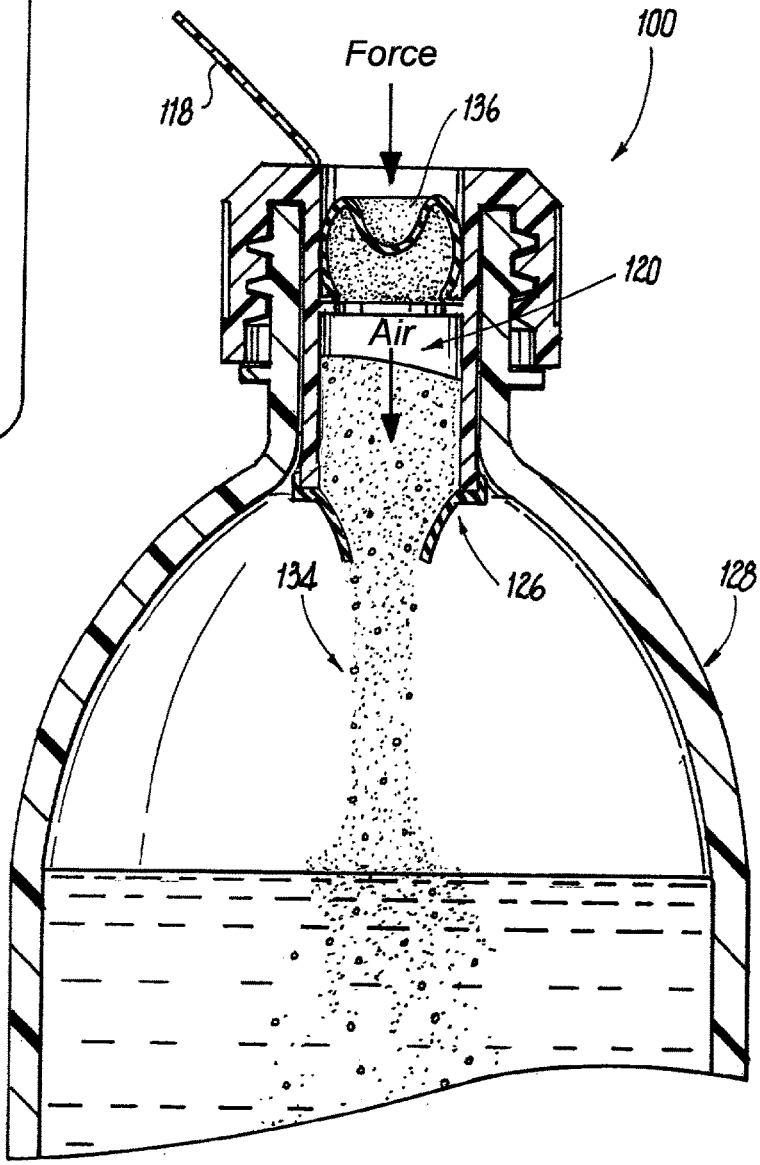

Fig. 6
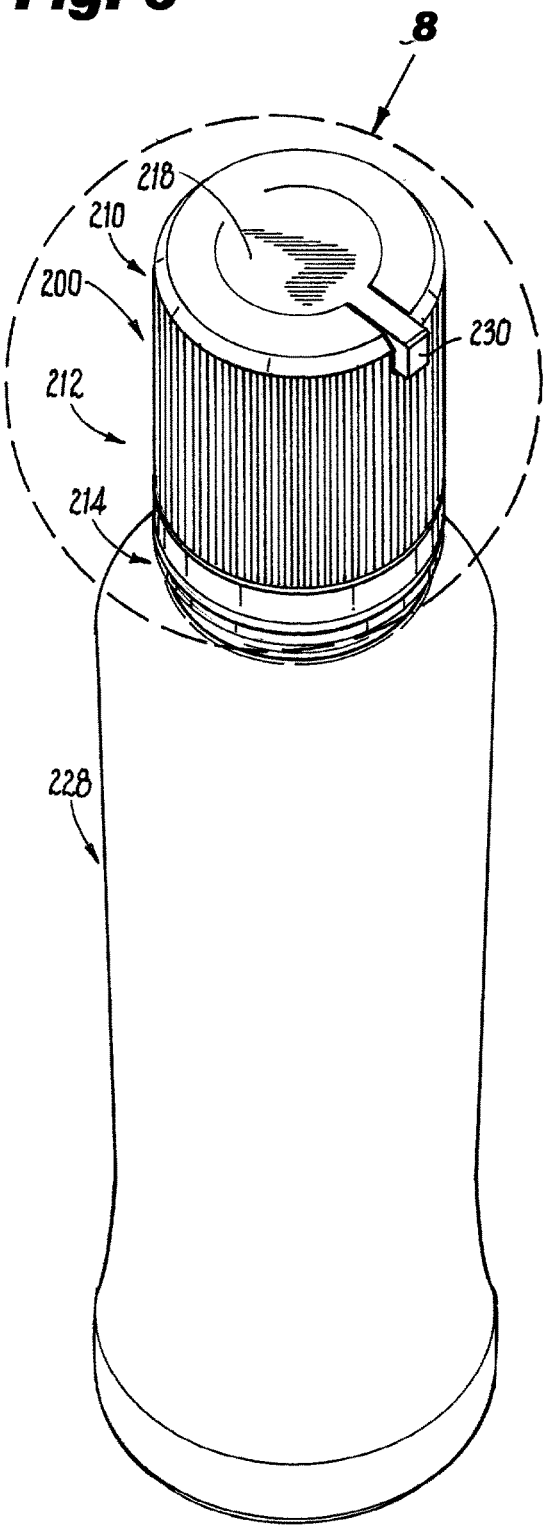
Fig. 7
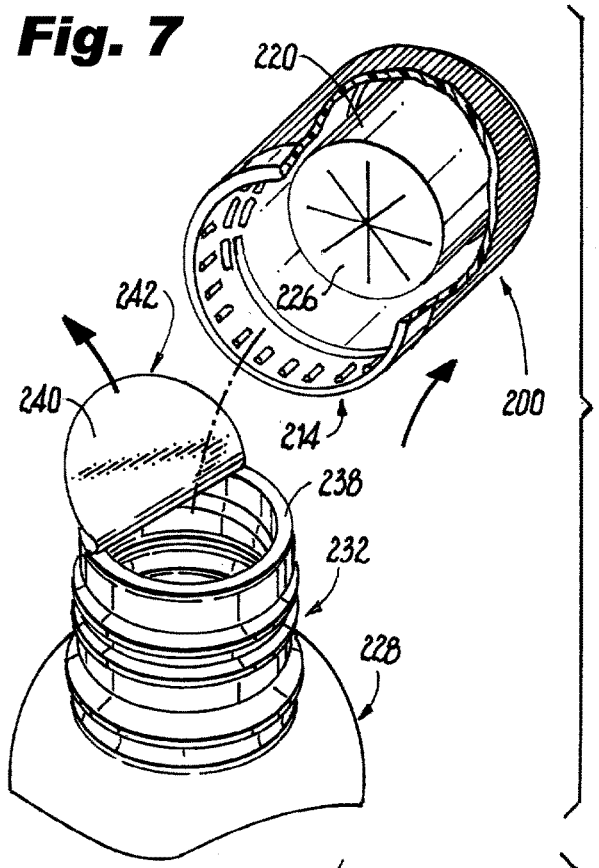
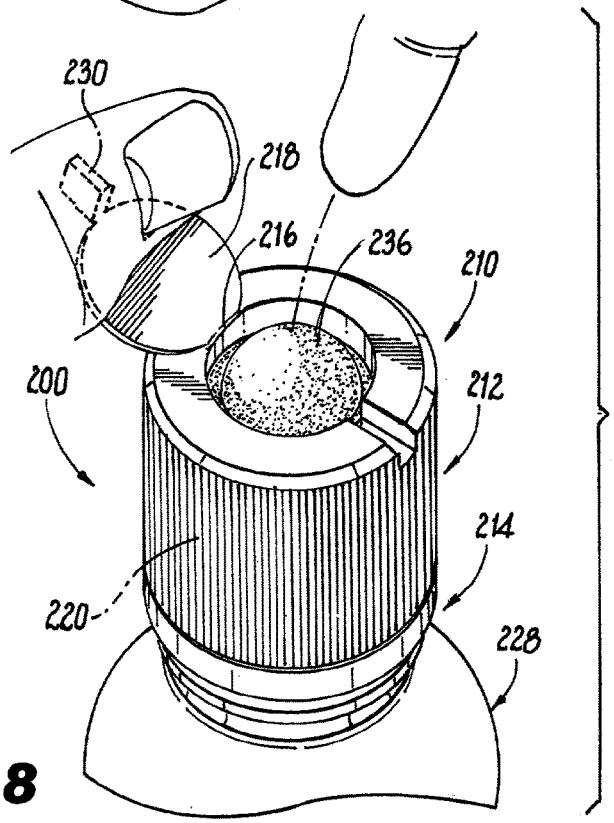
Fig. 8

Fig. 11
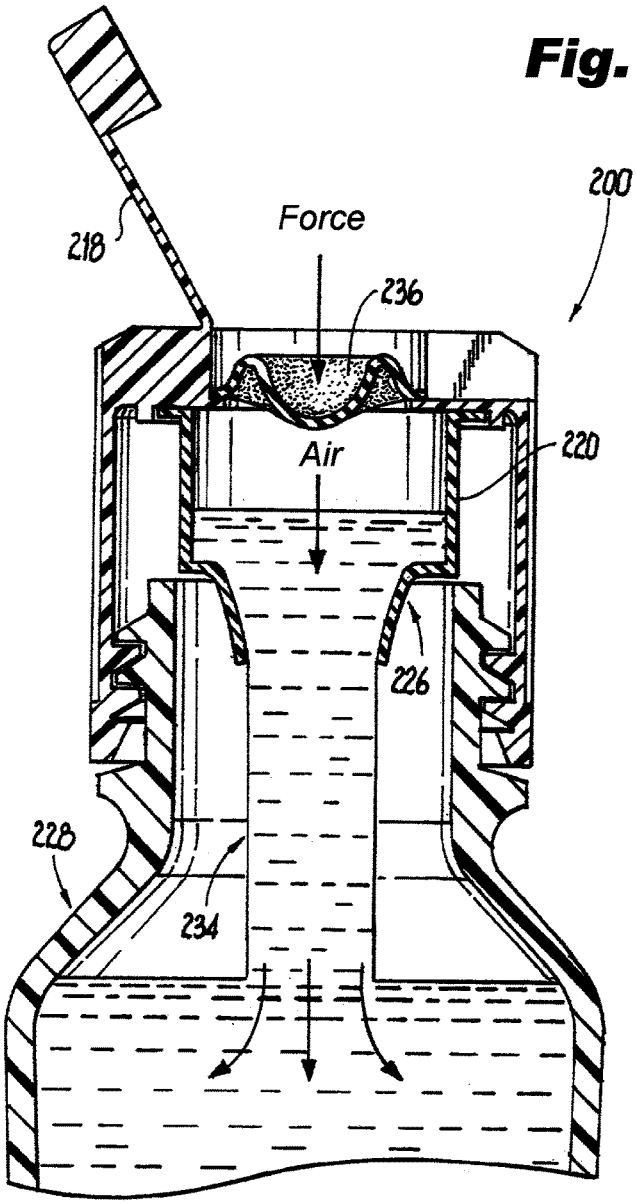
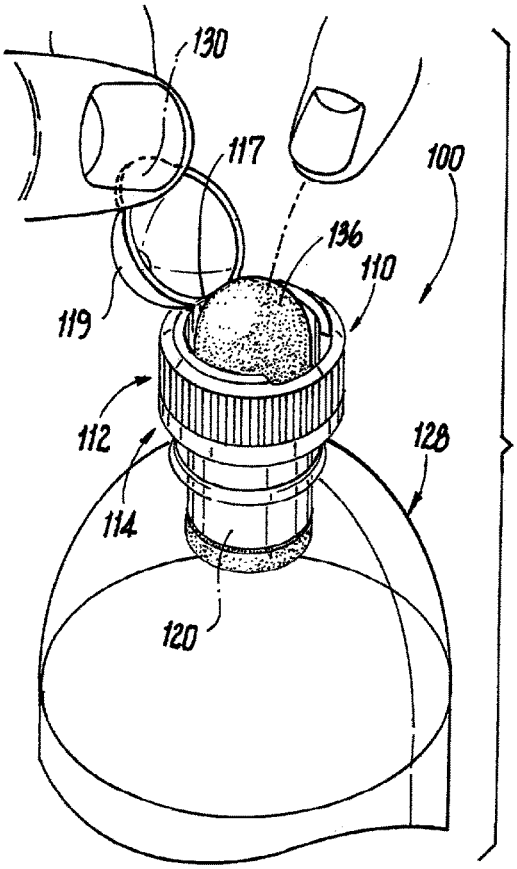
Fig. 12

BOTTLE CAP DEVICE WITH PRESSURIZED RELEASE

BACKGROUND OF THE INVENTION

1. Field of the Invention

The subject invention is directed to a bottle cap device, and more particularly, to a bottle cap device for releasing a material into a bottle.

2. Description of Related Art

The use of conventional liquid containers for carrying materials for human consumption is quite well known. There are, however, several non-active and active materials, such as vitamins, minerals, herbs, nutrients, and flavors, that are more desirable when added to these containers directly by the consumer. Doing so may provide additional benefits, as pre-dispersed materials may have shorter shelf lives, discoloration, or face other quality control issues when previously combined with liquids or other substances.

Such conventional methods and systems have generally been considered satisfactory for their intended purpose. Exemplary bottle cap devices can be seen in, for example, U.S. Pat. Nos. 8,408,389; 7,874,420; 7,017,735; 8,443,970 and 8,230,777, all of which are incorporated by reference in their entirety. However, there is still a need in the art for improved methods and systems for dispersing a material into a bottle. The present disclosure provides a solution for this need.

SUMMARY OF THE DISCLOSURE

The subject invention is directed to a new and useful bottle cap device. The bottle cap comprises a top portion, which comprises a hingeable lid, a middle portion, which comprises a reservoir for retaining a material, and a bottom portion, which is surrounded by a threading that further comprises a means for attaching to a bottle. The top portion of the bottle cap further comprises a depressible button for exerting pressure in the reservoir, wherein the reservoir further contains a means for releasing the material into the bottle upon the exertion of pressure from the depressible button.

In certain embodiments, the button of the bottle cap device may also comprise a convex plunger, and may also be covered by a disposable cover. In certain embodiments, the button of the bottle cap device may also comprise a convex plunger, and may also be covered by a non-disposable cover. The top portion may further comprise a thumb flip configured to expose the top portion via a cap pivotally attached to a hinge.

In certain embodiments, the reservoir for retaining a material further contains a means for releasing the material into the bottle upon the exertion of pressure from the depressible button, which may comprise a breakable membrane, that may be scored, such as in a pie-slice-like fashion, and is disposed within the interior of the threading. In preferred embodiments, the breakable membrane comprises two or more scored pie-slice sections. The threading may comprise a means for attaching to a lip of the bottle, and the threading may comprise a means for detaching from the lip of the bottle. The means for attaching or detaching the threading to the bottle may comprise an o-ring or other attachment configurations known to those skilled in the art.

For example, the configuration for attaching or detaching the threading to the bottle may comprise a snap-on structure.

In certain embodiments, the subject invention may also be directed to a new and useful method of dispersing a material into a bottle. This method comprises exposing a top portion of a bottle cap as previously defined, and applying an activating force to said button to disrupt the breakable membrane and thereby release the material into the bottle.

In certain embodiments, the bottle cap may comprise a top portion, which comprises a hingeable lid, wherein the top portion further comprises a flip top, such as a thumb flip top, configured to expose the top portion via a cap pivotally attached to a hinge. The bottle cap may also comprise a middle portion, which comprises a reservoir for retaining a material, wherein the middle portion includes a pie-slice breakable membrane, wherein the pie-slice breakable membrane comprises two or more sections. The bottle cap can include a bottom portion, surrounded by a threading, wherein the threading comprises a means for attaching and detaching from a lip of a bottle, the bottom portion further comprising the pie-slice breakable membrane disposed within the interior of the threading. In certain embodiments, the top portion further comprises a depressible button for exerting pressure in the reservoir, wherein the depressible button further comprises a cover to cover said button. In certain embodiments, the reservoir further contains a means for releasing the material into the bottle upon the exertion of pressure from the depressible button, wherein said means for releasing comprises the pie-slice scored breakable membrane disposed within the interior of the threading. In certain embodiments, the button of the bottle cap device may be covered by a disposable cover. In certain embodiments, the button of the bottle cap device may be covered by a non-disposable cover.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 4 is an exploded view of the bottle cap device of FIG. 1;

FIG. 5 is a perspective view of the deployment of the bottle cap device of FIG. 1, illustrating the rupturing of the pie-slice breakable membrane;

FIG. 6 is a perspective view of an additional embodiment of the bottle cap device of the subject invention;

FIG. 7 is a perspective view of the bottle cap device of FIG. 6, and the manner of affixing to a container;

FIG. 8 is a localized perspective view of the bottle cap device of FIG. 6, as affixed to a container;

FIG. 11 is a perspective view of the deployment of the bottle cap device of FIG. 6, illustrating a later period of the rupturing of the pie-slice breakable membrane; and FIG. 12 is a localized perspective view of an alternate embodiment of the bottle cap device of FIG. 1, as affixed to a container;

DETAILED DESCRIPTION OF THE PREFERRED EMBODIMENTS

Figure 1:
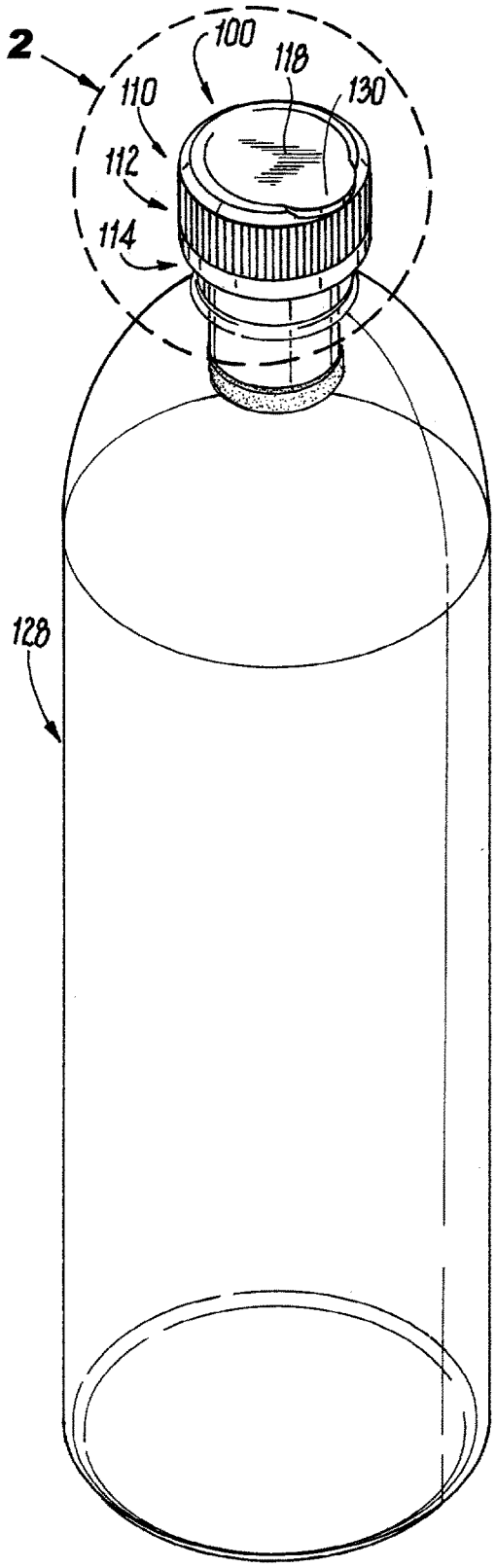
FIG. 1 is a perspective view of the bottle cap device of the subject invention.

Referring now to the drawings wherein like reference numerals identify similar structural elements and features of the subject invention, there is illustrated in FIG. 1 a perspective view of the bottle cap device of the subject invention, which is designated generally by reference number 100, with top portion 110, middle portion 112 and bottom portion 114. Other embodiments and/or aspects of this disclosure are shown in FIGS. 2-11.

Figure 2:
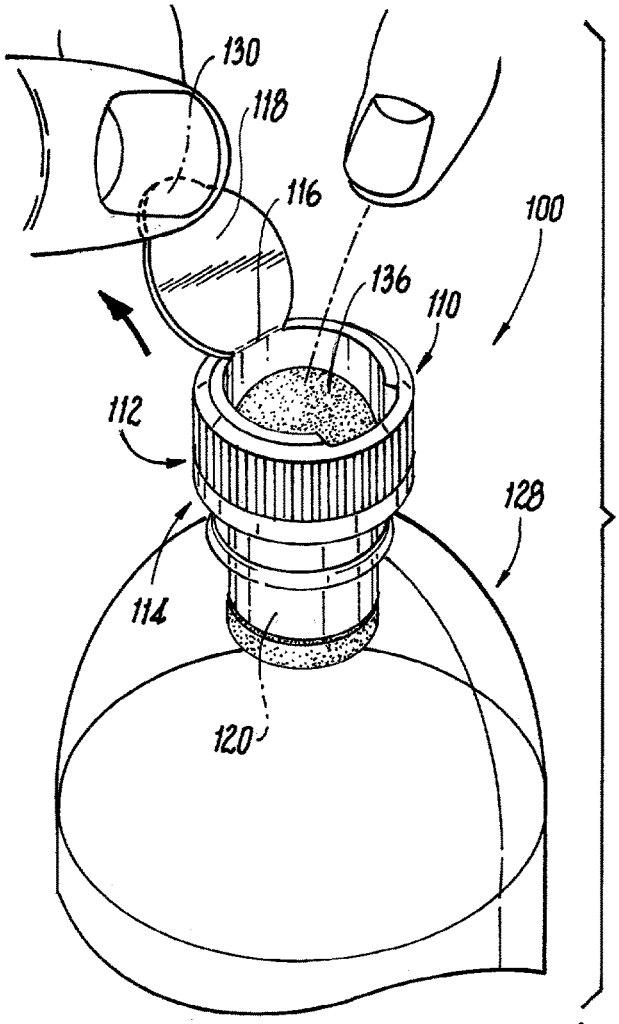
FIG. 2 is a localized perspective view of the bottle cap device of FIG. 1, as affixed to a container.

Referring to FIG. 2, the bottle cap 100 includes the top portion 110, which comprises a hingeable lid 118 (which can include a thumb flip extension 130, the middle portion 112, which comprises a reservoir 120 for retaining a material 134 (not pictured), and the bottom portion 114, which is surrounded by a threading that further comprises a means for attaching to the bottle 128. The top portion 110 of the bottle cap 100 further comprises a depressible button 124 for exerting pressure into the reservoir 120. The top portion 110 may further comprise a thumb flip 130 configured to expose the top portion 110 via a cap 118 pivotally attached to a hinge 116. The button 124 of the bottle cap device 100 may also comprise a convex plunger 136, and may also be covered by a disposable cover (not pictured). In certain embodiments, the button 124 of the bottle cap device 100 may also comprise a convex plunger 136, and may also be covered by a non-disposable cover (not pictured). The reservoir 120 further contains a means for releasing the material 134 into the bottle 128 upon the exertion of pressure from the depressible button 124. FIG. 12 illustrates an additional embodiment, wherein the button 136 may be elevated above the top portion 110, and may be sealed by chamber 119 as affixed by hinge 117.

Figure 3:
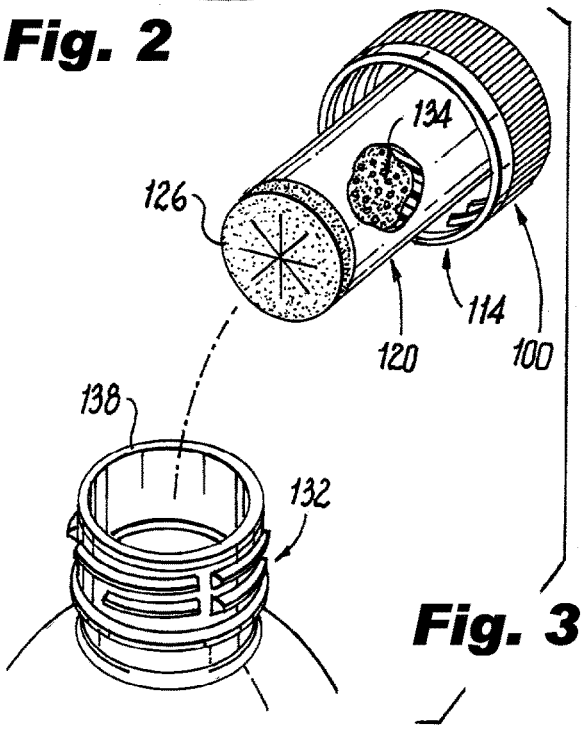
FIG. 3 is a perspective view of the bottle cap device of FIG. 1, and the manner of affixing to a container.

Referring additionally to FIG. 3, the threading may further comprise a means for attaching to a lip 138 of the bottle 128, and the threading may comprise a means for detaching from the lip 138 of the bottle 128, such as screw-like threading or a snap on feature. Referring again to FIGS. 1 and 4, the means for attaching or detaching the threading to the bottle 128 may comprise an o-ring. It is considered that the means for attaching or detaching the threading to the bottle 128 may optionally comprise a snap-on structure. In this way, a pie-slice scored breakable membrane 126 can be inserted into the bottle 128. FIG. 4 offers an exploded view of the bottle cap device of FIG. 1. Referring to FIG. 5, in certain embodiments, the reservoir 120 for retaining a material 134 further contains a means for releasing the material 134 into said bottle 128 upon the exertion of pressure from the depressible button 124, which may comprise a pie-slice scored breakable membrane 126 disposed within the interior of the threading, as seen in FIG. 4. The pie-slice scored breakable membrane 126 may comprise two or more sections, such that when the membrane 126 is broken the reservoir 120 of the middle section 112 is in open communication with the interior of the bottle 128. Also illustrated in FIG. 5, in certain embodiments, the subject invention may also be directed to a new and useful method of dispersing a material 134 into a bottle 128. This method comprises exposing a top portion 110 of a bottle cap 100 as previously defined, and applying an activating force to said button 124 to disrupt the breakable membrane 126 and thereby release the material 134 into the bottle 128.

In certain embodiments, the bottle cap 100 may comprise a top portion 110, which comprises a hingeable lid 118, wherein the top portion 110 further comprises a thumb flip 130 configured to expose the top portion 110 via a cap 118 pivotally attached to a hinge 116. The bottle cap 100 may also comprise a middle portion 112, which comprises a reservoir 120 for retaining a material 134, wherein the middle portion 112 includes a pie-slice scored breakable membrane 126, wherein the pie-slice scored breakable membrane 126 comprises two or more sections. The bottle cap 100 can include a bottom portion 114, surrounded by a threading, wherein the threading comprises a means for attaching and detaching from a lip 138 of a bottle 128, the bottom portion 114 further comprising the pie-slice breakable membrane 126 disposed within the interior of the threading. In certain embodiments, the top portion 110 further comprises a depressible button 124 for exerting pressure in said reservoir 120, wherein the depressible button 124 further comprises a cover (not pictured) to cover said button 120. In certain embodiments, said reservoir 120 further contains a means for releasing said material 134 into said bottle 128 upon the exertion of pressure from said depressible button 124, wherein said means for releasing may comprise a pie-slice scored breakable membrane 126 disposed within the interior of the threading. In certain embodiments, the button 124 of the bottle cap 100 may be covered by a disposable cover (not pictured). In certain embodiments, the button 124 of the bottle cap 100 may be covered by a non-disposable cover (not pictured).

The subject of the current disclosure provides a material dispensing bottle cap 100 that is mounted via a threading on a container lip 138 of any type liquid container including, for example, packs, bags, cans, and plastic or glass bottles. With a bottle 128 as the example, the subject of the current disclosure may be mounted typically on top of the neck 138 or throat 138 of a container, such as a bottle of water. The material 134 stored within the reservoir 120 is completely sealed within the reservoir 120, and remains separated from the contents of the bottle 128 until the exact moment of usage, which is determined by the consumer by manually depressing the depressible button 124 and dispensing the material 134 via the pie-slice breakable membrane 126. The material 134 can comprise liquid or solid materials and may comprise on or more of a flavorant, a juice, vitamins, herbs, nutrients and other mixable ingredients known to those of ordinary skill in the art. Once activated, the contents of the bottle 128 can be consumed by the user by removing the device from the primary container opening.

The subject of the current disclosure also offers the advantage that the bottle cap 100 does not require significant modification of existing liquid containers, packages, cartons, bottle caps, or existing bottles, for example. The bottle cap 100 can be mounted to many variations of circular openings of containers. In certain embodiments, the subject of the current disclosure can be screwed onto a primary container via threaded openings, bottle necks and spouts. In certain embodiments, the subject of the current disclosure can be snapped onto existing primary container threaded openings, bottle necks, and spouts.

FIG. 6 illustrates via a perspective view of the bottle cap device of the subject invention, which is designated generally by reference number 200, with top portion 210, middle portion 212 and bottom portion 214, affixed to bottle 228.

Referring additionally to FIG. 2, a threading may further comprise a means for attaching to a lip 238 of the bottle 228, and the threading may comprise a means for detaching from the lip 238 of the bottle 228, such as screw-like threading or a snap on feature. The means for attaching or detaching the threading to the bottle 228 may comprise an o-ring. It is considered that the means for attaching or detaching the threading to the bottle 228 may optionally comprise a snap-on structure. In this way, a pie-slice scored breakable membrane 226 can be inserted into the bottle 228.

Referring to FIG. 8, the bottle cap 200 includes the top portion 210, which comprises a hingeable lid 218 (which can include a thumb flip extension 230, the middle portion 212, which comprises a reservoir 220 for retaining a material 234 (not pictured), and the bottom portion 214, which is surrounded by the threading that further comprises a means for attaching to the bottle 228. The top portion 210 of the bottle cap 200 further comprises a depressible button 224 for exerting pressure into the reservoir 220. The top portion 210 may further comprise a thumb flip 230 configured to expose the top portion 210 via a cap 218 pivotally attached to a hinge 216. The button 224 of the bottle cap device 200 may also comprise a convex plunger 236, and may also be covered by a disposable cover 242, as seen in FIG. 7. In certain embodiments, the button 224 of the bottle cap device 200 may also comprise a convex plunger 236, and may also be covered by a non-disposable cover, also seen in FIG. 7. The reservoir 220 further contains a means for releasing the material 234 into the bottle 228 upon the exertion of pressure from the depressible button 224.

Figure 9:
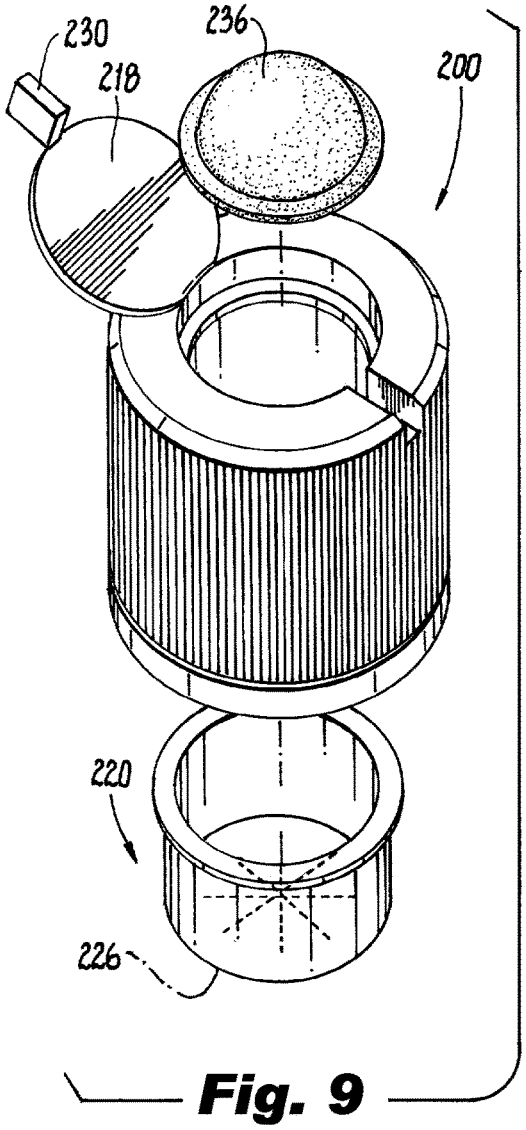
FIG. 9 is an exploded view of the bottle cap device of FIG. 6.
Figure 10:
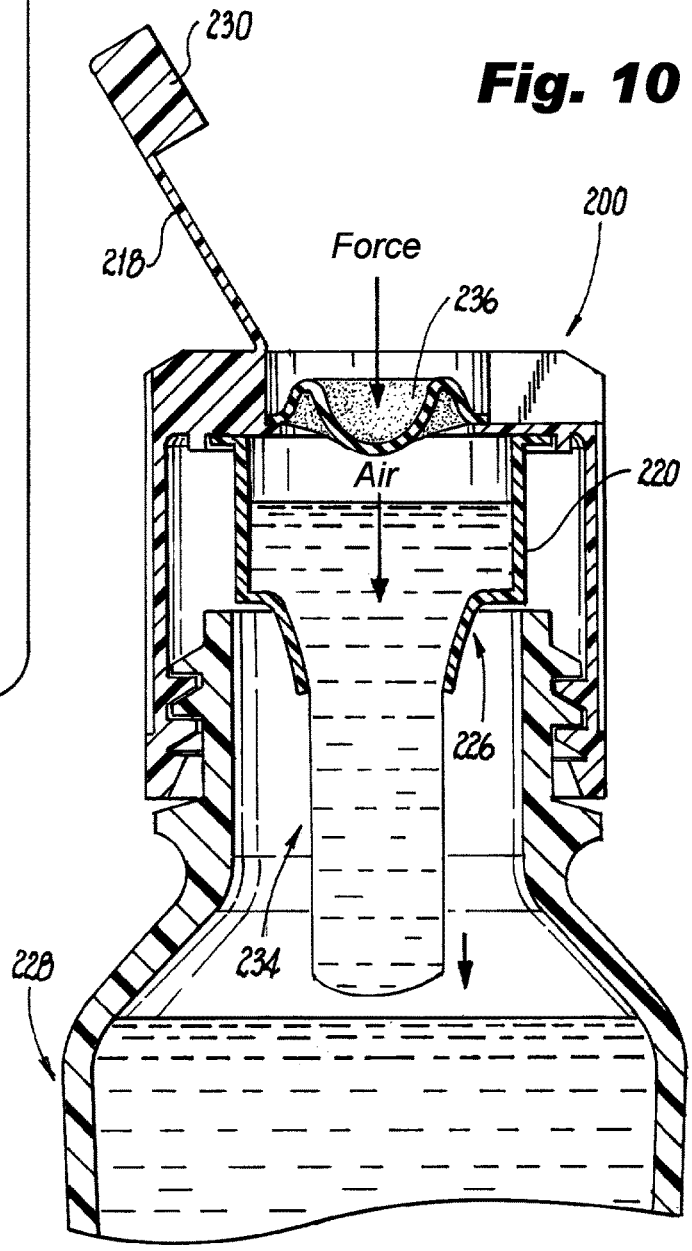
FIG. 10 is a perspective view of the deployment of the bottle cap device of FIG. 6, illustrating the rupturing of the pie-slice breakable membrane.

FIG. 9 offers an exploded view of the bottle cap device of FIG. 6. Referring to FIG. 10, in certain embodiments, the reservoir 220 for retaining a material 234 further contains a means for releasing the material 234 into said bottle 228 upon the exertion of pressure from the depressible button 224, which may comprise a pie-slice scored breakable membrane 226 disposed within the interior of the threading, as seen in FIG. 9. The pie-slice scored breakable membrane 226 may comprise two or more sections, such that when the membrane 226 is broken the reservoir 220 of the middle section 212 is in open communication with the interior of the bottle 228. Also illustrated in FIG. 10, in certain embodiments, the subject invention may also be directed to a new and useful method of dispersing a material 234 into a bottle 228. This method comprises exposing a top portion 210 of a bottle cap 200 as previously defined, and applying an activating force to said button 224 to disrupt the breakable membrane 226 and thereby release the material 234 into the bottle 228. FIG. 11 illustrates a later period of the rupturing of the pie-slice breakable membrane introduced in FIG. 10.

In certain embodiments, the bottle cap 200 may comprise a top portion 210, which comprises a hingeable lid 218, wherein the top portion 210 further comprises a thumb flip 230 configured to expose the top portion 210 via a cap 218 pivotally attached to a hinge 216. The bottle cap 200 may also comprise a middle portion 212, which comprises a reservoir 220 for retaining a material 234, wherein the middle portion 212 includes a pie-slice scored breakable membrane 226, wherein the pie-slice scored breakable membrane 226 comprises two or more sections. The bottle cap 200 can include a bottom portion 214, surrounded by a threading, wherein the threading comprises a means for attaching and detaching from a lip 238 of a bottle 228, the bottom portion 214 further comprising the pie-slice breakable membrane 226 disposed within the interior of the threading. In certain embodiments, the top portion 210 further comprises a depressible button 224 for exerting pressure in said reservoir 220, wherein the depressible button 224 further comprises a cover 240 to cover said button 220. In certain embodiments, said reservoir 220 further contains a means for releasing said material 234 into said bottle 228 upon the exertion of pressure from said depressible button 224, wherein said means for releasing may comprise a pie-slice scored breakable membrane 226 disposed within the interior of the threading. In certain embodiments, the button 224 of the bottle cap 200 may be covered by a disposable cover (not pictured). In certain embodiments, the button 224 of the bottle cap 200 may be covered by a non-disposable cover (not pictured).

The subject of the current disclosure provides a material dispensing bottle cap 200 that is mounted via a threading on a container lip 238 of any type liquid container including, for example, packs, bags, cans, and plastic or glass bottles. With a bottle 228 as the example, the subject of the current disclosure may be mounted typically on top of the neck 238 or throat 238 of a container, such as a bottle of water. The material 234 stored within the reservoir 220 is completely sealed within the reservoir 220, and remains separated from the contents of the bottle 228 until the exact moment of usage, which is determined by the consumer by manually depressing the depressible button 224 and dispensing the material 234 via the pie-slice breakable membrane 226. The material 234 can comprise liquid or solid materials and may comprise on or more of a flavorant, a juice, vitamins, herbs, nutrients and other mixable ingredients known to those of ordinary skill in the art. Once activated, the contents of the bottle 228 can be consumed by the user by removing the device from the primary container opening.

The subject of the current disclosure also offers the advantage that the bottle cap 200 does not require significant modification of existing liquid containers, packages, cartons, bottle caps, or existing bottles, for example. The bottle cap 200 can be mounted to many variations of circular openings of containers. In certain embodiments, the subject of the current disclosure can be screwed onto a primary container via threaded openings, bottle necks and spouts. In certain embodiments, the subject of the current disclosure can be snapped onto existing primary container threaded openings, bottle necks, and spouts.

While the subject disclosure has been shown and described with reference to preferred embodiments, those skilled in the art will readily appreciate that changes or modifications may be made thereto without departing from the spirit or scope of the subject disclosure.

What is claimed is:

1. A bottle cap, comprising:

a top portion, comprising a hingeable lid and a depressible button configured to exert a pressure when depressed, wherein the hingeable lid is configured to hinge between an open position and a closed position, wherein in the open position the depressible button is exposed, and in the closed position the depressible button is not exposed;

a middle portion, comprising a reservoir for retaining a material, wherein the reservoir is in fluid communication with the top portion to receive the pressure from the top portion exerted by the depressible button when depressed to increase a pressure of the reservoir; and a bottom portion, surrounding circumferentially means for attaching the bottle cap to a threading of a bottle;

wherein the reservoir further comprises a means for releasing the material into the bottle, wherein the means for releasing comprises a pie-slice breakable membrane disposed at a bottom surface of the reservoir, wherein the depressible button is configured to pass a fluid from the top portion to the reservoir to increase a pressure of the reservoir such that the breakable membrane breaks to release the material into the bottle, wherein the reservoir is configured to extend into an interior portion of the bottle such that the pie-slice breakable membrane is disposed below the threading of the bottle and below a neck of the bottle with the bottle cap attached to the threading of the bottle via the means for attaching the bottle cap to the threading of the bottle, wherein with the bottle cap attached to the threading of the bottle, the depressible button is disposed within the threading of the bottle such that in a depressed position, the depressible button is entirely within the threading of the bottle.

2. The bottle cap of claim 1, wherein the depressible button comprises a convex plunger.

3. The bottle cap of claim 1, wherein the pie-slice breakable membrane comprises two or more pie-slice sections.

4. The bottle cap of claim 1, further comprising a disposable cover configured to cover the top portion.

5. The bottle cap of claim 1, further comprising a non-disposable cover configured to cover the top portion.

6. The bottle cap of claim 1, wherein the means for attaching the bottle cap to the bottle comprises a threading for attaching the bottle cap to a threading of the lip of the bottle.

7. The bottle cap of claim 6, further comprising a means for sealing the threading of the bottle cap to the bottle, wherein the means for sealing comprises an O-ring.

8. The bottle cap of claim 1, wherein the means for attaching the bottle cap to the bottle comprises a snap-on structure configured to snap the bottle cap onto the lip of the bottle.

9. The bottle cap of claim 1, wherein the means for attaching the bottle cap to the bottle includes a threading, wherein the threading is a reversible threading configured for detaching the bottle cap from the lip of the bottle.

10. The bottle cap of claim 1, wherein the hingeable lid further comprises a thumb flip extending radially beyond an outer diameter of the top portion to allow a user to move the hingeable lid from the closed position to the open position.

11. A method of dispersing a material into a bottle, comprising:

exposing an interior of the top portion of the bottle cap of claim 1; and applying an activating force to said button to increase a pressure within the reservoir to disrupt the pie-slice breakable membrane and thereby release the material into the bottle.

12. The bottle cap of claim 1, wherein the depressible button does not extend into the reservoir.

13. The bottle cap of claim 1, wherein a length of the top portion plus a length of the middle portion is greater than a length of the bottom portion.

14. The bottle cap of claim 1, wherein a length of the top portion plus a length of the middle portion is configured to be greater than a length of a neck of the bottle.

15. A bottle cap, comprising:

a top portion defining a first chamber having a cylindrical shape configured to attach the bottle cap to an existing bottle, the top portion including a depressible button disposed within the first chamber and a hingeable lid configured to provide access to the depressible button within the first chamber;

a middle portion defining a second chamber below the first chamber having a cylindrical shape and configured to extend into an interior of the existing bottle with the top portion attached to the existing bottle, the second chamber including a reservoir for retaining a material and a breakable membrane disposed at a lower end of the reservoir for releasing the material from the reservoir into the interior of the bottle, wherein the middle portion is configured to extend into the interior of the existing bottle such that the breakable membrane is positioned below a threaded section of the existing bottle; and a bottom portion radially outward from the top portion, wherein a threaded annulus is defined radially between the bottom portion and the top portion, wherein the threaded annulus is configured to receive a threaded neck of the existing bottle such that the bottom portion is configured to thread the bottle cap onto the existing bottle with the middle portion within the interior of the existing bottle, wherein in a non-depressed state, the depressible button is fully within the first chamber, and wherein in a depressed state, the depressible button is configured to be fully within the top portion and fully within the threaded neck of the existing bottle, wherein in both the non-depressed state and the depressed state, the depressible button remains within the first chamber and does not extend into the second chamber, wherein the first chamber is in fluid communication with the second chamber such that depressing the depressible button passes a fluid from the first chamber to the second chamber increasing a pressure within the reservoir and wherein the breakable membrane is configured to break due to the increased pressure within the reservoir, wherein the breakable membrane is configured to break along one or more scores defined in the breakable membrane.

16. The bottle cap of claim 15, wherein a length of the top portion plus a length of the middle portion is greater than a length of the bottom portion.

17. The bottle cap of claim 15, wherein a length of the top portion plus a length of the middle portion is configured to be greater than a length of the threaded neck of the existing bottle.

18. The bottle cap of claim 15, wherein the depressible button has a convex shape in a non-depressed state and has a concave shape in a depressed state.

19. A bottle cap, comprising:

a top portion configured to attach the bottle cap to an existing bottle, the top portion including a first chamber and a depressible button disposed within the first chamber;

a middle portion operatively connected to the top portion and extending from the top portion, the middle portion including a second chamber separate from and below the first chamber, the second chamber configured to hold a material to be dispensed into the existing bottle, wherein the second chamber is configured to extend into an interior of the existing bottle with the top portion attached to the existing bottle, wherein the middle portions further comprises a breakable membrane disposed at a lower end of the second chamber for releasing the material from the second chamber into the interior of the bottle;

wherein the first chamber is in fluid communication with the second chamber such that depressing the depressible button passes a fluid from the first chamber into the second chamber, increasing a pressure within the second chamber and wherein the breakable membrane is configured to break due to the increased pressure within the reservoir.

* * * * *